United States Patent [19]

Kunimi

[11] 4,100,397

[45] Jul. 11, 1978

[54] THERMOSTATICALLY CONTROLLED ELECTRICAL HEATER ASSEMBLY

[75] Inventor: Yuri Kunimi, Belmont, Mass.

[73] Assignee: The Gillette Company, Boston, Mass.

[21] Appl. No.: 703,571

[22] Filed: Jul. 8, 1976

[51] Int. Cl.[2] ..... H05B 1/02; H05B 3/02; H01H 37/52

[52] U.S. Cl. ..... 219/512; 132/37 R; 219/225; 219/241; 219/517; 219/534; 219/541; 337/1; 337/377

[58] Field of Search ..... 219/221, 227, 229, 236–241, 219/533, 510–513, 523, 222–226, 494, 516, 517, 251–253, 302–305, 307, 308, 328, 331, 335–337, 441–442, 449, 450, 541, 534; 132/37 R, 37 A, 33 R; 337/1, 141, 100, 107, 120, 377, 324, 182–185

[56] References Cited

U.S. PATENT DOCUMENTS

| | | | |
|---|---|---|---|
| 1,533,230 | 4/1925 | Colby | 219/238 |
| 2,073,259 | 3/1937 | Young | 219/238 X |
| 2,456,030 | 12/1948 | Sohms | 219/241 |
| 2,576,976 | 12/1951 | Stagner | 219/302 X |
| 2,648,757 | 8/1953 | Harper | 219/241 UX |
| 2,866,885 | 12/1958 | McIlrath | 219/517 X |
| 2,908,793 | 10/1959 | Aloi | 219/513 X |
| 2,995,159 | 8/1961 | Berggren | 219/241 UX |
| 3,068,339 | 12/1962 | De Kay et al. | 219/523 |
| 3,439,150 | 4/1969 | Wells et al. | 219/510 X |
| 3,487,197 | 12/1969 | D'Elia et al. | 219/241 X |
| 3,488,471 | 1/1970 | Gstalder | 219/241 X |
| 3,560,703 | 2/1971 | Chedister | 219/516 X |
| 3,646,577 | 2/1972 | Ernst | 219/241 |
| 3,678,246 | 7/1972 | Blachly | 219/441 X |
| 3,934,114 | 1/1976 | Godel et al. | 219/222 |
| 4,004,596 | 1/1977 | Hyland | 219/241 X |

*Primary Examiner*—A. Bartis

*Attorney, Agent, or Firm*—Richard A. Wise; Oistein J. Bratlie; Donald E. Mahoney

[57] ABSTRACT

An electrical heater assembly comprising a heat generating element and a temperature regulating device supported by a heat conducting core of electrically insulating material is constructed to provide a thermal path for conducting heat from the heat generating means to the temperature regulating device with minimum thermal resistance, whereby temperature fluctuation is minimized. The temperature regulating device is substantially encircled by terminal means electrically coupling the temperature regulating device in circuit with the heat generating element. The temperature regulating means is disposed substantially entirely within a cavity in the core so that substantially all of the outer peripheral surface of the terminal means is in friction contact with the surface of the cavity.

9 Claims, 5 Drawing Figures

THERMOSTATICALLY CONTROLLED ELECTRICAL HEATER ASSEMBLY

BACKGROUND OF THE INVENTION

1. Field of the Invention

This invention is related to a heater assembly and more particularly to heater assemblies having an improved thermal path between a heating element and a temperature regulating device.

2. Description of the Prior Art

Prior art electrical heater assemblies have been arranged to operate a unit such as a heatable hair curling element at a regulated surface temperature. Typically the heater assemblies include a heater element in the form of a coil of resistance wire in thermal contact with the hair curling element. The heater element converts electrical energy to thermal energy which, in turn, is thermally conducted to the hair curling element. A thermostat or thermal switch is serially connected between the heater element and a source of electrical energy in order to regulate the temperature of the heater element. The thermostat operates in an ON condition to provide a low impedance or conductive path for current to the heater element when the heater element temperature is below a predetermined critical level. When the heater element temperature exceeds the critical level, the thermostat operates in an OFF condition to prevent further current conduction and heat generation by the heater element, whereby the heater element temperature decreases to a level below the critical temperature and the heating cycle begins again.

In prior art heater assemblies, the thermostat is held away from the heater element by a heat conducting clamp having one end thermally coupled to the heater element. An undesired temperature fluctuation or cyclical change of heater element temperature with time beyond a desired heater element temperature occurs when the thermostat is turned ON and OFF. The magnitude of temperature fluctuation is increased when the thermal path between the heater element and thermostat has a high thermal resistance. Accordingly, a heater assembly is provided in which temperature fluctuation is minimized by improving heat conduction from the heater element to the thermostat.

SUMMARY OF THE INVENTION

A heater assembly comprises heater means for generating heat in response to an electrical signal, a temperature regulating means for conducting the electrical signal to the heater means over a preferred operating temperature range of the heater means, and a heat conducting core of electrically insulating material for supporting the heater means and the temperature regulating means. The temperature regulating means is substantially encircled by terminal means electrically coupling the temperature regulating means in circuit with the heater means. The core has a cylindrical cavity in which the temperature regulating means is coaxially disposed with the terminal means in friction contact with the core whereby the core provides a thermal path having a selected thermal resistance for conducting heat from the heater means to the temperature regulating means to minimize temperature fluctuation of the heater means.

DESCRIPTION OF THE PREFERRED EMBODIMENT

Figure 1:
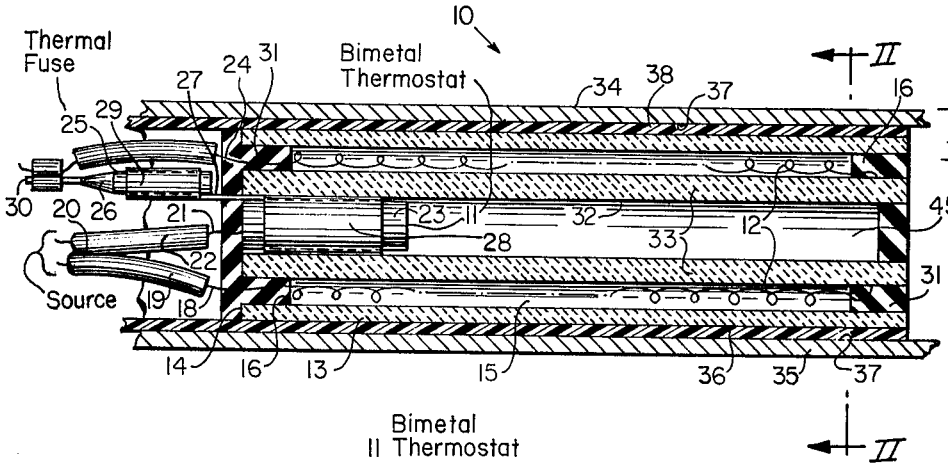
FIG. 1 is a longitudinal view, partially in section, of a heater assembly according to the invention.
Figure 2:
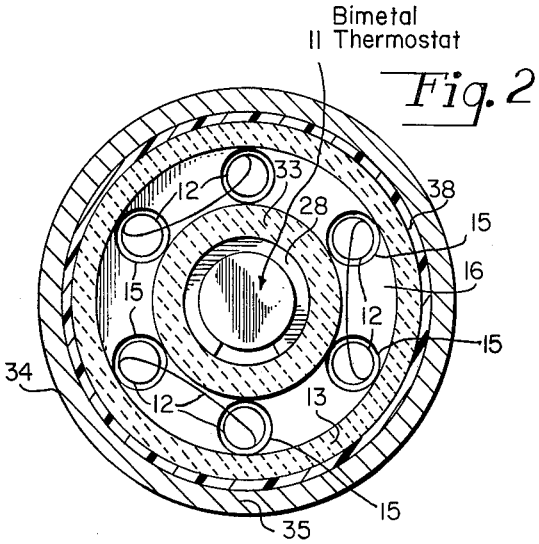
FIG. 2 is a cross-section of the heater assembly shown in FIG. 1 taken along the line 2—2.

Referring to FIGS. 1 and 2, there is shown a partially sectioned longitudinal view, and a cross-section of an electrical heater assembly 10. The heater assembly 10 includes a temperature regulating device 11 for regulating thermal energy provided by a heat generating element 12 acting in response to an electrical signal. The temperature regulating device 11 controls the operation of the heat generating element 12 in a manner that permits the heat generating element 12 to have a temperature fluctuation. As defined in this specification and graphically shown in FIG. 3, temperature fluctuation is a cyclical change in heater element 12 temperature beyond a desired temperature which occurs when the temperature regulating device 11 turns the heat generating element 12 ON and OFF.

The heater assembly 10 comprises a heat conducting core 13 supporting the heat generating element 12 and the temperature regulating device 11, such as a thermostat. The thermostat 11 is designed to conduct current to the heat generating element 12 over a preferred operating temperature range of the heat generating element 12. The heat conducting core 13 is formed from an electrically insulating material offering minimum thermal resistance to the conduction of heat provided by the heat generating element 12. As an example, the heat conducting core 13 is a ceramic tube having a wall 14 with a plurality of longitudinally extending holes 15 and a wall recess 16 at each end of the core 13. The heat generating element 12 may be a coil of wire, having a high resistivity, such as a Nichrome wire, disposed within the holes 15 and wall recess 16. The coil 12 could also be wound about a peripheral surface of the ceramic core 13. As known in the prior art, the coil 12 generates heat in proportion to the product of the coil resistance and the square of the current conducted by the resistive wire 12. It will be appreciated that the time required for an energized coil having a selected resistance to reach a desired temperature is substantially determined by the current level conducted by the coil 12. However, merely increasing the level of current conducted by coil 12 in prior art heater assemblies would increase the magnitude of temperature fluctuation particularly initial thermal overshoot or initial increase in coil temperature beyond a desired coil temperature.

The thermostat 11 may be a conventional temperature sensitive bi-metallic switch having a pair of points, not shown, normally in contact with each other. The points open or draw apart when a bi-metallic element, not shown, senses a temperature exceeding a critical level. The thermostat 11 may be serially connected between a source of electrical energy, not shown, and the coil 12. The thermostat 11 is connected to provide a low impedance current conducting path when the thermostat 11 is in an ON condition and the switch points are in contact with each other at a coil temperature below the critical level. However, when the temperature of the coil 12 exceeds the critical level, the thermostat 11 operates in an OFF condition when the bi-metallic element causes the switch points to open to prevent further heat producing current from being conducted to the coil 12, whereby the temperature of the coil 12 decreases over a period of time.

An example of a circuit having the thermostat 11 serially connected between coil 12 and source include a first end 18 of the coil 12 connected to an electrical source via a first conductor 19 of a cable 20. A first terminal 21 of the thermostat 11 is connected to a second conductor 22 of the cable 20. A thermostat second terminal 23 or thermostat external surface may be connected to a second end 24 of the coil to complete the circuit. If desired, a conventional temperature sensitive fuse 25 may be serially connected between the second terminal 23 of the thermostat 11 and the second end 24 of the coil 12 to provide a high impedance to current if the thermostat 11 should fail to operate in the OFF condition. Terminal means for electrically connecting the thermostat second terminal 23 to a fuse first terminal 26 or external surface include a clamp 27 having a tubular-shaped first end 28 in friction contact with the thermostat second terminal 23 and a tubular-shaped second end 29 in friction contact with the fuse first terminal 26. A fuse second terminal 30 is connected to the coil second end 24 to complete the circuit. A seal 31 of electrically insulating material, such as silicone, may be deposited in the wall recess 16 to protect the coil 12 from moisture and short circuits.

It will be appreciated that any delay by the thermostat 11 in interrupting current conduction to the coil 12 after the critical temperature level is exceeded will increase the level of temperature fluctuation since the coil 12 will continue to generate heat. It has been determined that temperature fluctuation is minimized by decreasing the thermal resistance of the thermal path between the thermostat 11 and coil 12. Unlike prior art heater assemblies having a thermal path between the thermostat 11 and coil 12 including a medium, such as air, having a relatively high thermal resistance, the thermostat 11 and clamp end 28 of the terminal means are disposed within a cavity 45 in the core 13 with the clamp end 28 in friction contact with an internal surface 32 of the core wall 14. A portion 33 of the core wall 14 between the coil 12 and thermostat 11 is selected to have minimum thickness and low thermal resistance relative to air, whereby temperature fluctuation is minimized since the thermostat 11 is able to react quickly to changes in coil temperature.

The heater assembly 10 may be used to regulate the temperature of an external surface 34 of a heat conducting tube 35 by being disposed within the tube 35 so that an external surface 36 of the core wall 14 is in thermal contact with an internal surface of a tube wall 37. A thin film 38 of electrically insulating material, such as polyimide, may be inserted between the external core wall 36 and the internal surface 37 of the tube wall to prevent arcing between the coil 12 and tube 35 should the core wall 14 be cracked or damaged while current is being conducted by the coil 12.

Figure 3:
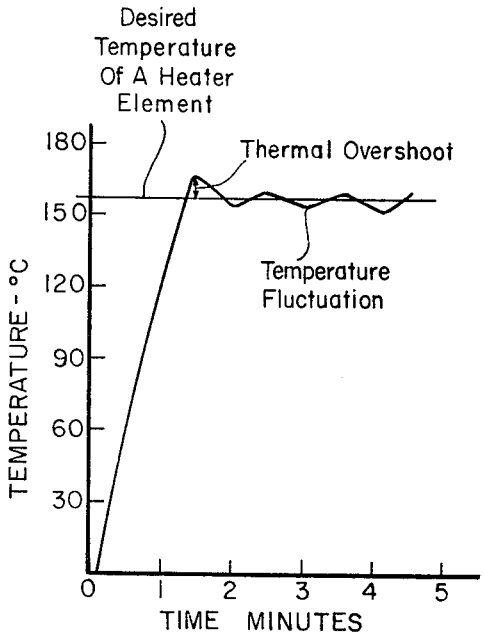
FIG. 3 is a graphical representation of a heat generating element temperature versus time.
Figure 5:
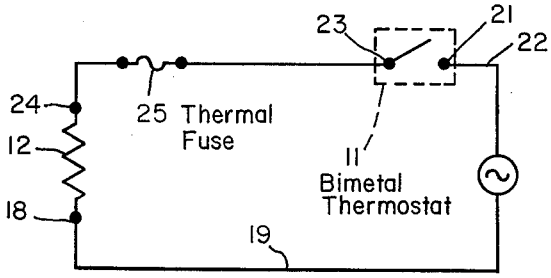
FIG. 5 is a schematic diagram of electrical wiring for the heater means.

Referring to FIG. 3, there is shown a graphical representation at the temperature characteristics of the heating assembly 10 employing the heater coil 12 with a resistance of 160 ohms and the ceramic core 13 with the wall portion 33 being 0.045 inches and having a thermal conductivity in the range of 1 to 2 Btu ft/ft$^2$ °F hr. The heating assembly 10 acts in response to an electrical signal of 120 volts, 0.75 amps to provide a regulated tube surface 34 temperature of substantially 157° C with 5° C of initial thermal overshoot.

Figure 4:
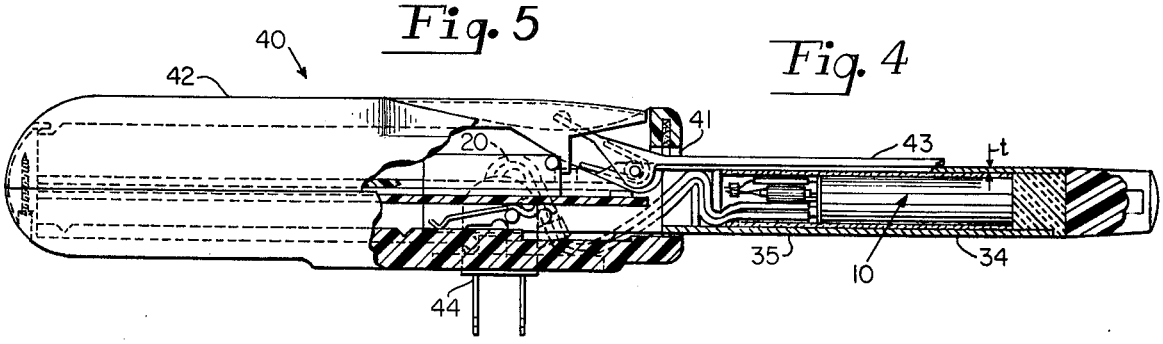
FIG. 4 is a longitudinal view, partially in section of a curling iron including the heater assembly.

Referring to FIG. 4, there is shown a portable curling iron 40 having the heater assembly 10 and heat conducting tube 35 extending from an end 41 of a curling iron handle 42. Current is conducted to the heater coil 12 (FIG. 1) when a plug 44 connected to an end of the cable 20 is coupled to a receptacle, or source of electrical energy, not shown. Electrical current conducted by the coil 12 causes the heater assembly 10 to increase the temperature of an external surface 34 of the tube 35 to a level suitable for curling a tress of hair held against the tube surface 34 by a typical curling iron clamp 43. The tube 35 has a wall thickness, t, selected to enable the tube 35 to retain sufficient heat to curl several tresses of hair after the coil 12 ceases to generate heat when the plug 44 is disconnected from the receptacle. In the manner discussed above, the heater assembly 10 is designed to regulate the temperature of the tube surface 34 and to minimize temperature fluctuation, whereby the level of current conducted to the coil may be increased in order to quickly heat the tube surface 34 to a hair curling temperature.

One embodiment of the invention has been shown and described only by way of example. Various other embodiments and modifications thereof will be apparent to those skilled in the art and will fall within the scope of the invention as defined by the following claims.

What is claimed as new and desired to be secured by Letters Patent of the United States is:

1. A heater assembly comprising:

electrically energized heater means for generating heat;

temperature regulating means substantially encircled by terminal means electrically coupling said temperature regulating means in circuit with said heater means for controlling operation of said heater means over a preferred operating temperature range of said heater means; and a heat conducting core of electrically insulating material for supporting said heater means and said temperature regulating means, said core having a cavity and said temperature regulating means being coaxially disposed substantially entirely within said cavity with said terminal means having substantially all of its outer peripheral surface in friction contact with the surface of said cavity, and separated from said heater means by the material of said core, whereby said core and said terminal means provide a thermal path having a selected thermal resistance for conducting heat from said heater means to said temperature regulating means to minimize temperature fluctuation of said heater means.

2. A heater assembly according to claim 1, wherein said heater means is a coil of resistance wire for generating heat.

3. A heater assembly according to claim 1, wherein said temperature regulating means is a thermal switch arranged to control operation of said heater means over said preferred operating temperature range.

4. A heater assembly according to claim 1, wherein said heat conducting core is a tube having a central bore defining said cavity in which said temperature regulating means is disposed and a tube wall separating said heater means from said temperature regulating means to provide said thermal path for conducting heat from said heater means to said temperature regulating means.

5. A heater assembly according to claim 4, wherein said tube wall has a plurality of longitudinally extending holes through which said heater means extends in a plurality of longitudinally extending reaches.

6. A tubular heater assembly comprising:

electrically energized heater means for generating heat in response to an electrical signal;

temperature regulating means substantially encircled by terminal means electrically coupled to said heater means for conducting said electrical signal to said heater means over a preferred operating temperature range of said heater means; and a heat conducting tubular core for supporting said heater means and said temperature regulating means with said temperature regulating means coaxially disposed substantially entirely within the cavity of said tubular core with said terminal means having substantially all of its outer peripheral surface in friction contact with the surface of said cavity and separated from said heater means by the material of said core, thereby providing a thermal path having a selected thermal resistance for conducting heat from said heater means to said temperature regulating means to minimize temperature fluctuation.

7. A tubular heater assembly according to claim 6, wherein said temperature regulating means is a thermostat having a bi-metallic element for separating a normally contacting pair of points when said heater means is at a temperature exceeding a critical level.

8. A tubular heater assembly according to claim 6, wherein said heater means is a coil of resistance wire supported by said core for generating heat in response to said electrical signal.

9. A tubular heater assembly according to claim 8, wherein said coil is disposed within a plurality of cavities longitudinally extending through said core wall.

* * * * *